United States Patent [19]

Colbourne

[11] 4,385,767

[45] May 31, 1983

[54] MOVABLE TARGETS

[75] Inventor: Robert Colbourne, Chichester, England

[73] Assignee: Easams Limited, Chelmsford, England

[21] Appl. No.: 162,624

[22] Filed: Jun. 24, 1980

[30] Foreign Application Priority Data

Jul. 2, 1979 [GB] United Kingdom ..... 7922925

[51] Int. Cl.[3] ..... F41J 9/02

[52] U.S. Cl. ..... 273/359; 273/363

[58] Field of Search ..... 273/61 D, 359–370, 273/406, 408, 348, 380; 46/90

[56] References Cited

U.S. PATENT DOCUMENTS

| | | | |
|---|---|---|---|
| 205,220 | 6/1878 | Turner | 273/362 |
| 1,969,128 | 8/1934 | Harrison | 273/61 D X |
| 2,093,818 | 9/1937 | Read | 273/359 X |
| 2,490,793 | 12/1949 | Fleming | 273/363 |
| 2,698,496 | 1/1955 | Miller | 46/90 |
| 2,805,066 | 9/1957 | Mongello | 273/406 |
| 3,411,778 | 11/1968 | Barry | 273/363 X |
| 3,536,232 | 10/1970 | Lightcap | 46/90 X |
| 3,869,123 | 3/1975 | McDaniel | 273/359 |

FOREIGN PATENT DOCUMENTS

| | | | |
|---|---|---|---|
| 262849 | 6/1968 | Austria | 273/380 |
| 737643 | 10/1932 | France | 273/359 |
| 1118015 | 6/1968 | United Kingdom | 273/406 |

OTHER PUBLICATIONS

American Rifleman 6–1967 p. 63, Pistol Target Mechanism Operated by Compressed Gas.

Popular Science, vol. 179, No. 4, 10–1961 p. 145 Moving Target For Archery Practice.

*Primary Examiner*—Paul E. Shapiro

*Attorney, Agent, or Firm*—Kirschstein, Kirschstein, Ottinger & Cobrin

[57] ABSTRACT

A three-dimensional movable gunnery target comprises an envelope of flexible material such as rubber, neoprene, plastics material or fabric, which is rapidly dilatable to a predetermined shape, for example by internal gas pressure from a chemical or pyrotechnic device, or from a compressed gas bottle. The target, which is capable of rolling under the action of wind or gravity, encloses an axle from which a compressed gas bottle is suspended.

1 Claim, 2 Drawing Figures

MOVABLE TARGETS

The present invention relates to movable targets, for example for instruction in the use of anti-armour weapons. Such targets may be required to be mobile and agile, that is, able to change speed and/or direction, and in some cases to be expendable.

According to the present invention a movable target comprises an envelope formed of flexible material and means within or communicating with the interior of said envelope to dilate said envelope to a predetermined shape. The envelope may be substantially gas-tight.

Preferably said dilated envelope is capable of rolling under the action of wind or gravity or other motive power. The means to dilate the envelope may be arranged to be activated by remote command, the activation being achieved for example by radio control, by mechanical stimulus, by an electrical signal, by laser or by ultrasonic command. The means to dilate the envelope may comprise a pyrotechnic or chemical device or a bottle of compressed gas, for example air, or a compressor or blower, or an expansible framework. The envelope may enclose an axle, and the bottle of compressed gas or some other weight may be suspended from this axle.

Movable targets in accordance with the invention will now be described by way of example with reference to the accompanying drawing.

Figure 1:
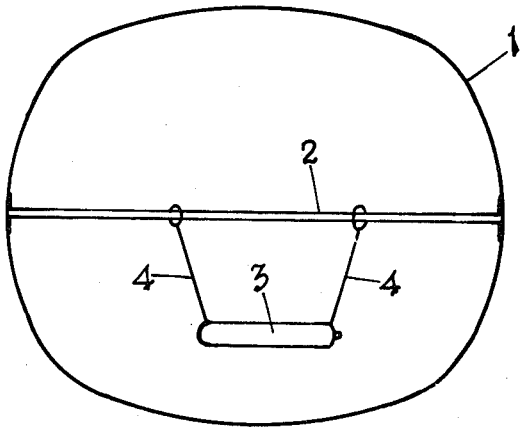
FIGS. 1 and 2 show respective forms of target.
Figure 2:
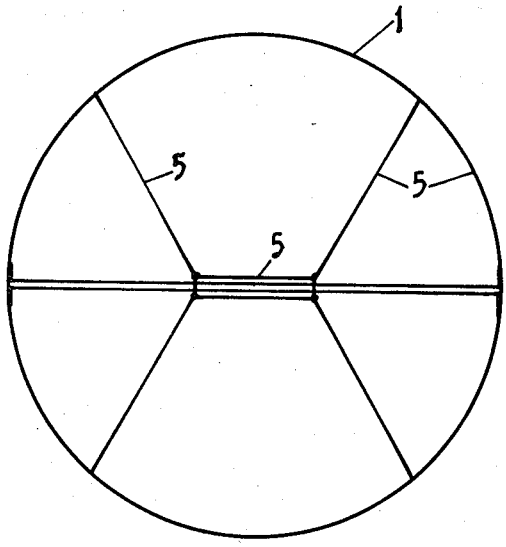

Referring to the drawing, the target comprises an envelope 1 of rubber, neoprene or of a flexible plastics or fabric material which may be reinforced and which is dilatable to a spherical shape, as shown in FIG. 2, a barrel shape, as shown in FIG. 1, or generally cylindrical shape. The target of FIG. 1 has a central axle 2 from which is suspended a heavy bottle 3 of compressed gas by means of which the envelope is inflated.

The target may be deployed in a deflated state in or near the target area, near the top of a slope or in a windy location. On command from a remote control point or at a preprogrammed time compressed gas is released from the bottle 3, inflating the envelope to a pressure determined by the quantity of inflating gas or by a relief valve. Once inflated the target will roll down the slope or be blown by the wind, with the air bottle 3 hanging from the axle 2 giving stability. The path of the target may be determined by the contours of the terrain, by the wind, by channels carved out for the purpose, or by various forms of tethering. The size of the target would be determined by the training requirements, but of the order of two meters diameter would be typical.

The air bottle 3, or an equivalent weight, may be suspended at the apex of a triangle having the centre section of the axle 2 as its base and its sides consisting of two suspension cords or cables 4. By severing one of these suspension cords 4 after a predetermined time, for example by an electrical, mechanical, chemical or pyrotechnic fuse (not shown), the target can be given a bias that will cause it to change direction, that is, to exhibit agility.

Alternatively, a stabilising weight may be moved systematically across the centre part of the axle, for example by hanging it from a threaded section so that it moves across as the target rolls down the slope or down wind.

The speed of the rolling target may be controlled by various devices which could be either pre-set, preprogrammed or remotely controlled.

Because of the air pressure within the target and because the target is a closed container, a hit by a projectile could be sensed from the predeterminable changes in pressure, followed in most cases by deflation of the target and its effective removal from the scene. Most targets that are hit could be recovered and repaired for subsequent re-use.

As an alternative to compressed gas, the target may be inflated by making the axle of a large diameter hollow tube with perforations (not shown), within which is located a pyrotechnic device such as a smoke generator. Triggered on command, the smoke generator would inflate the target, and any excess smoke appearing from a relief valve would produce the 'puff' often used to signify a target to be engaged. A projectile puncturing the target would release the smoke, giving a visible hit indication. Valves at the ends of the hollow axle could be opened by remote control or by hit sensors on the target to produce more smoke and/or to deflate the target when hit, or at the end of the programmed run. An advantage of this form of target is that the strong and resilient fabric that could be chosen for the inflatable structure would resist puncture by relatively slow-moving debris from near misses, thus avoiding false hit indications.

One or more additional pyrotechnic devices may be triggered to give a more dramatic hit indication.

A more elaborate version of the target (not shown), with more realistic appearance and motion, may be produced by using two cylindrical inflatables in tandem, joined externally by a suitable framework attached to the axles 2. This version is stabilised by a weight hung from the frame between the inflatables, thus avoiding the need for mechanisms inside the envelopes.

The axles may be omitted if desired, the compressed gas bottle or pyrotechnic device either being loose within the envelope or attached to the inner surface thereof. Alternatively, the envelope may be inflated by a fan or pump driven by an external source of power, for example a battery powered electric motor. Provision may be made for restraining the envelope during inflation and for releasing it after a predetermined inflation has been achieved.

Provision may be made for deflating the envelope after a pre-set time, or after moving a predetermined distance or on command. In the alternative version of the invention shown in FIG. 2, the envelope 1 is not necessarily gas tight or complete and dilation of the envelope 1 (and its subsequent collapse) is accomplished by expansion of a framework 5 attached to the envelope 1. The envelope may be constructed of metal, plastic, glassfibre, wood or other material or of inflatable tubes.

I claim:

1. A movable three-dimensional gunnery target which is capable of rolling under the action of wind or gravity, comprising a substantially gas-tight envelope which is formed of flexible material and which is dilatable to a predetermined shape, an axle within said envelope, a bottle of compressed gas which is suspended from said axle, and means operable by remote control to dilate said envelope with compressed gas from said bottle.

* * * * *